United States Patent [19]

Mita et al.

[11] 4,052,166

[45] Oct. 4, 1977

[54] CONVERTER WITH CATALYST PELLETS

[75] Inventors: Yasuhiro Mita, Higashi-yamato; Takayuki Yamazaki, Tokyo; Takahisa Izumi, Fujisawa, all of Japan

[73] Assignee: Nissan Motor Company, Limited, Yokohama, Japan

[21] Appl. No.: 737,155

[22] Filed: Oct. 29, 1976

[30] Foreign Application Priority Data

Oct. 30, 1975 Japan ..... 50-148390[U]

[51] Int. Cl.[2] ..... B01V 8/02

[52] U.S. Cl. ..... 23/288 F; 23/288 R; 23/284; 55/518; 55/494; 55/DIG. 37; 52/473; 52/673

[58] Field of Search ..... 23/288 F, 288 FC, 288 R, 23/284; 55/518, 494, DIG. 37; 52/473, 673, 674

[56] References Cited

U.S. PATENT DOCUMENTS

| | | | |
|---|---|---|---|
| 3,695,850 | 10/1972 | Perga et al. | 23/288 F |
| 3,766,536 | 10/1973 | Hile | 23/288 F X |
| 3,799,748 | 3/1974 | Scheitlin et al. | 23/288 F |
| 3,818,667 | 6/1974 | Wagner | 23/288 F X |

*Primary Examiner*—James H. Tayman, Jr.
*Attorney, Agent, or Firm*—Bacon & Thomas

[57] ABSTRACT

A pellet holding casing disposed in a container is formed at its wall sections with a plurality of louvers that extend outwardly away from the casing. Each of the louvers is formed with at least one channel shaped corrugation in substantially the top portion thereof for providing the converter with improved characteristics with respect to flow resistance and thermal expansion.

5 Claims, 14 Drawing Figures

CONVERTER WITH CATALYST PELLETS

BACKGROUND OF THE INVENTION

The present invention relates in general to a catalytic converter for catalytically treating the exhaust gases emitted from an internal combustion engine and more particularly, to a catalytic converter having therein a pellet holding casing in which a plurality of catalyst pellets is contained or packed.

SUMMARY OF THE INVENTION

It is an object of the present invention to provide an improved catalytic converter with catalyst pellets which provides minimum flow resistance to the exhaust gases passing therethrough.

It is another object of the present invention to provide a catalytic converter having therein an improved catalyst pellet casing which can maintain its pellet holding capacity even under considerable heat expansion.

It is still another object of the present invention to provide an improved catalytic converter which is manufactured in a relatively inexpensive manner.

It is a further object of the present invention to provide a pellet type catalytic converter for catalytically treating the exhaust gases emitted from an internal combustion engine, comprising a container, exhaust gas inlet means at one end of the container, exhaust gas outlet means at the other end of the container, and a catalytic pellet holding casing supported within the container so that the exhaust gases emitted from the engine through the inlet means pass through the holding means before reaching the outlet means, which is characterized in that the catalyst pellet holding casing is provided at its walls with a plurality of louvers that extend outwardly away from the casing, further in which each of the louvers is formed with at least one channel shaped corrugated is substantially the top portion thereof, the channel shaped corrugation extending longitudinally with the louvers so that the louver has a generally corrugated cross section.

Other objects and advantages of the present invention will become more apparent from the following description when taken in conjunction with the accompanying drawings.

DETAILED DESCRIPTION OF PREFERRED EMBODIMENTS

Prior to the explanation of the construction of the catalytic converter including therein the improved louvered sheet according to the present invention, description of the conventional converter shown in FIG. 1 will be made in order to clarify the inventive steps of this invention.

Figure 1:
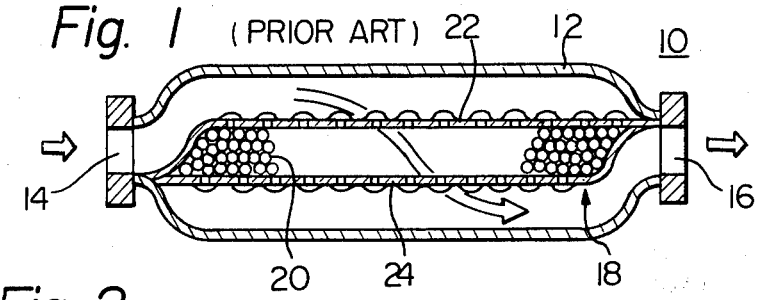
Fig. 1 (PRIOR ART)
FIG. 1 is a sectional view of a prior art catalytic converter with catalyst pellets, this view showing in a container a catalyst pellet-holding casing provided at its walls with a plurality of conventional louvers.
Figure 2:
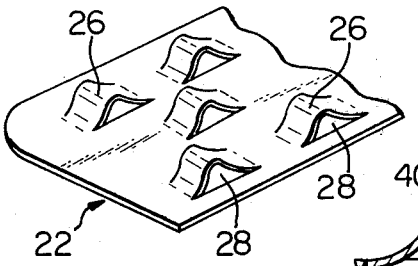
Fig. 2 (PRIOR ART)
FIG. 2 is a partial perspective view of a conventional louvered sheet used as a wall member of the pellet casing shown in FIG. 1.

In FIG. 1, the conventional catalytic converter designated by the numeral 10 is illustrated. The converter 10 is disposed in an exhaust conduit system of an internal combustion system engine (not shown) and generally comprises a container 12 having an exhaust gas inlet opening 14 at its upstream portion and an exhaust gas outlet opening 16 at its downstream portion. Within the container 12 is supported a catalyst pellet holding casing 18 which contains therein packed catalyst pellets 20. As shown, the casing 18 comprises upper and lower louvered sheets 22 and 24 each of which is formed with a plurality of louvers 26 that extend outwardly away from the casing 18. The detailed constructions of the louvers 26 in the upper louvered sheet 22 are more clearly seen in FIG. 2. As is clearly shown in the drawing, each of the louvers 26 consists of a curved plate portion integrally raised from a base portion of the sheet 22. The curved plate portion is formed at each side as a through hole 28 so as to provide a fluid communication between the interior of the casing 18 and the exterior of the casing 18. Thus, the exhaust gases coming from the engine through the inlet opening 14 are caused to pass through the interior of the casing 18 before reaching the outlet opening 16.

In reality, the above-mentioned conventional converter 10 can be produced in a relatively inexpensive manner, due to the reasonable productivity of such a casing 18.

On the other hand, in this conventional converter, however, there will inevitably arise the following drawbacks or disadvantages:

1. There may occur a change, as is clearly shown in FIG. 4A, that some of the catalyst pellets 20 are just snugly received in the through holes 28 defined by the respective louvers 26. In this case, the flow resistance of the casing 18 and thus that of the converter 10 are undersirably increased. This causes a high initial exhaust gas pressure or high back pressure with a result of bad fuel enconomy for the engine to which this converter 10 is connected.

2. When hot exhaust gases are fed into the converter 10 and then heat the louvered sheets 22 and 24, each louver 26 and its neighborhood in the louvered sheets 22 and 24 are subjected to thermal expansion to increase the opening area of each through hole 28, as will be seen from FIGS. 6A and 6B. Therefore, some of the pellets 20 may be passed away through the corresponding through holes 28 when the louvered sheets 22 and 24 are heated higher than a predetermined degree.

Therefore, as mentioned before, the present invention is proposed to eliminate the above-mentioned several drawbacks encountered in the conventional catalytic converter 10 with catalyst pellets.

Figure 3:
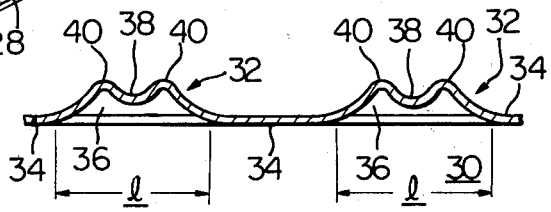
FIG. 3 is a partial sectional view of a louvered sheet, embodying the present invention, used as a wall member of an improved catalytic converter of the invention.

Referring to FIG. 3 of the drawings, there is illustrated an improved louvered sheet 30 which constitutes an improved pellet holding casing of a catalytic converter, according to the present invention. As is clearly shown in this Figure, the louvered sheet 30 is formed with a plurality of louvers 32 that project outwardly from a base portion 34 of the sheet 30. Each of the louvers comprises a curved plate portion having both ends thereof integral with the base portion 34 and a generally middle portion spaced apart from the base portion 34. Each louver 32 is provided at each end with an opening 36 for providing a fluid communication between the front and back sides of the sheet 30.

Now, according to the present invention, each of the louvers 32 is formed with a channel shaped corrugation 38 in the substantially top portion thereof. As shown, the channel shaped corrugation 38 extends longitudinally of the louver 32 so that each louver 32 has a generally corrugated cross section. Furthermore, in the case of FIG. 3, the width *l* of each louver 32 is determined considerably wider than twice the average diameter of the catalyst pellets 20. Most specifically speaking, each louver 32 must be formed in such a manner that two catalyst pellets 20 are exactly and respectively received in two hollow sections respectively defined behind the two outwardly projecting portions 40 while being spaced away from each other.

With this construction, the converter including therein the catalyst pellet holding casing made of the improved louvered sheet 30 can eliminate the above-mentioned drawbacks and disadvantages of the conventional converter.

For the purpose of explaining the reason why the converter with the louvered sheet 30 has improved characteristics with respect to flow resistance and thermal expansion in comparison with the conventional converter 10, there are prepared several illustrations in FIGS. 4A to 7B, in which FIGS. 4A to 5B are views for explaining the degree of the flow resistance and FIGS. 6A to 7B are views for explaining the degree of the thermal expansion.

Figure 4A:
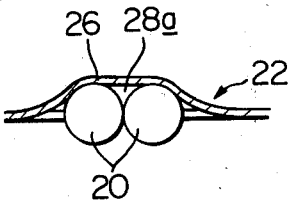
Fig. 4A (PRIOR ART)
FIGS. 4A and 4B are illustrations which show the degree of flow resistance of the prior art converter incorporating the conventional louvered sheet shown in FIG. 2.
Figure 5A:
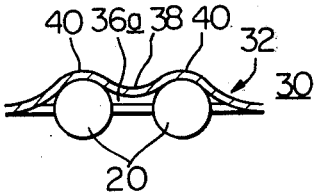
FIGS. 5A and 5B are illustrated which show the degree of flow resistance of the converter incorporating the improved louvered sheet according to the present invention.
Figure 4B:
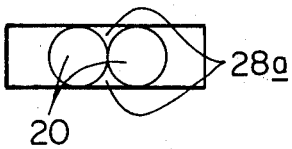
Figure 5B:
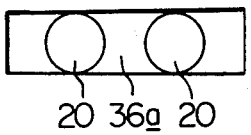

FIGS. 4A and 4B are respective sectional and plan views of the conventional louvered sheet 22 which is formed with the conventional louver 26, while FIGS. 5A and 5B are those of the improved sheet 30, with the improved louver 32, according to the present invention (in each case illustrating only a single louver).

As is clearly seen in FIG. 4A to 5B, two catalytic pellets 20 stuck in a hollow section defined by the conventional louver 26 are caused to contact each other thereby providing minimum gas flow space 28*a* therebetween; on the other hand, two pellets 20 exactly and respectively stuck in two hollow sections defined by the louver 32 on both sides of the channel shaped corrugations 38 are spaced apart from each due to the provision of the corrugation 38 providing a relatively large gas flow space 36*a* therebetween. This means that the converter with the subject louvered sheet 30 provides minimum flow resistance to the exhaust gases passing therethrough. In accordance with our several experiments, it became clear that the flow resistance of the converter with the improved pellet holding casing of the improved louvered sheet 30 reduces to about 70 to 75% the resistance of the conventional converter shown in FIG. 1.

Figure 6A:
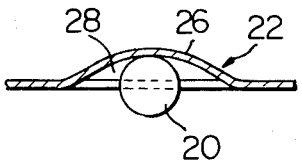
Fig. 6A (PRIOR ART)
FIGS. 6A and 6B are illustrations which show the degree of thermal expansion of the louver formed in the conventional louvered sheet of FIG. 2.
Figure 7A:
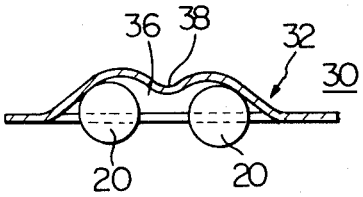
FIGS. 7A and 7B are illustrations which show the degree of thermal expansion of the louver of the improved louvered sheet of FIG. 3 according to the invention.
Figure 6B:
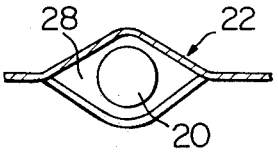
Figure 7B:
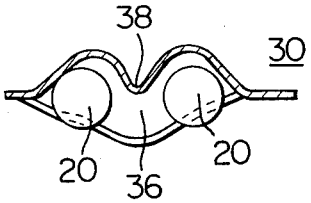

FIGS. 6A and 6B are respective sectional views, before and after heat application, of the conventional louvered sheet 22, while FIGS. 7A and 7B are respective sectional views, before and after heat application, of the improved louvered sheet 30.

From these FIGS. 6A to 7B, it will be clear that, when the sheet 22 is heated, the gas flow space 28 defined by the conventional louver 26 is remarkably increased to cause some of the pellets to drop away through the enlarged gas flow opening or space 28. On the other hand, the gas flow space 36 defined by the improved louver 32 is not largely open due to the inward expansion of the corrugation 38, so that the catalyst pellets 20 are kept in the louver 32.

Figure 8:
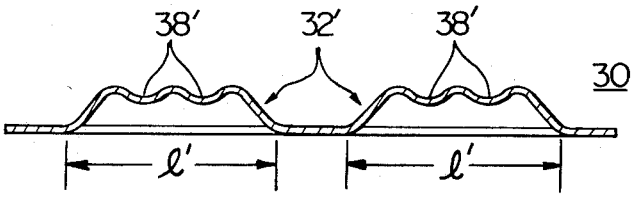
FIG. 8 is a partial sectional view of another improved louvered sheet also embodying the present invention.

Although, in the previous description, each of the louvers 32 of the improved louvered sheet 30 has been explained to have one corrugation 38 at the generally top portion thereof, it is also possible that each louver 32' has more than one channel shaped corrugation 38' as shown in FIG. 8.

In case of two corrugations, the width *l'* of the louver 32' is determined at least three times wider than the average diameter of the catalyst pellets 20 for the same reason as described in the case of FIG. 3.

Figure 9A:
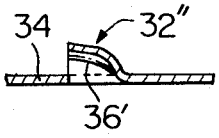
FIGS. 9A and 9B are partial sectional side and partial sectional front views of still another improved louvered sheet also embodying the present invention.
Figure 9B:
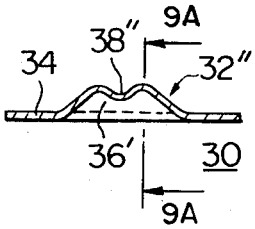

Furthermore, the louver may be so formed as shown in FIGS. 9A and 9B in which each louver 32'' comprises a pentroof or air scoop-shaped portion integrally projecting from a base portion 34 of the louvered sheet 30. The pentroof portion is provided with only one through opening 36' which provides a fluid communication between the front and back sides of the sheet 30.

As described above, the subject converter containing therein an improved catalyst pellet holding casing made of the improved louvered sheet 30 has excellently increased characteristics with respect to the flow resistance and thermal expansion in comparison with the conventional one.

Although, the present invention has been described with reference to a few preferred embodiments, it will be obvious to those skilled in the art that it is not so limited, but is susceptible to various other charges and modifications without departing from the spirit thereof.

What is claimed is:

1. A converter with catalyst pellets for catalytically treating the exhaust gases emitted from an internal combustion engine, comprising a container, an exhaust gas inlet at one end of said container, an exhaust gas outlet at the other end of said container, a catalyst pellet holding casing supported within said container so that the exhaust gases emitted from said engine through said inlet pass through said catalyst pellet holding casing before reaching said outlet, the catalytic pellet holding casing being provided at its walls with a plurality of louvers extending outwardly away from said casing, each of said louvers being formed with at least one channel shaped corrugation in substantially the top portion thereof, said channel shaped corrugation extending longitudinally with said louver so that the louver has a generally corrugated cross section.

2. A converter as claimed in claim 1, wherein each said louver comprises a curved plate portion having both ends thereof integral with a base portion of said wall and a generally middle portion spaced apart from said base portion, and wherein said louver comprises an opening at each side for providing a fluid communication between the interior of said casing and the exterior of said casing.

3. A converter as claimed in claim 1, wherein each said louver comprises a curved plate portion having both ends thereof and one side thereof integral with a base portion of said wall and a generally middle portion spaced apart from said base portion, and wherein said louver comprises an opening on the side opposite said integral side for providing a fluid communication between the interior of said casing and the exterior of said casing.

4. A converter as claimed in claim 2, wherein said louver includes one of said channel shaped corrugations and the longitudinal length of said louver is considerably longer than twice the average diameter of catalyst pellets contained in said casing, so that whe two pellets are respectively stuck in two hollow sections defined by the curved plate portion of said louver at both sides of said one channel shaped corrugation, said two pellets are spaced apart from each other.

5. A converter as claimed in claim 2, wherein said louver includes two of said channel shaped corrugations and the length of said louver is considerably longer than three times the average diameter of catalyst pellets contained in said casing, so that when three catalyst pellets are respectively stuck in three hollow sections defined by the curved plate portion of said louver at either side of each of said two channel shaped corrugations, said three pellets are spaced apart from one another.

* * * * *